US005651152A

United States Patent [19]

Ritchie et al.

[11] Patent Number: 5,651,152

[45] Date of Patent: Jul. 29, 1997

[54] STORAGE ORGANIZER FOR HOSPITAL BED

[76] Inventors: Jane E. Ritchie, 794 Bolinas Rd., Fairfax, Calif. 94930; Kenneth Tarlow, 94 Birch Ave., Corte Madera, Calif. 94925

[21] Appl. No.: 633,088

[22] Filed: Apr. 16, 1996

[51] Int. Cl.[6] ..... A47C 31/00

[52] U.S. Cl. ..... 5/503.1; 5/663; 294/143

[58] Field of Search ..... 5/503.1, 658, 663, 5/424; 190/109, 111; 224/411, 407; 211/86; 294/143, 146

[56] References Cited

U.S. PATENT DOCUMENTS

| | | | |
|---|---|---|---|
| 4,484,367 | 11/1984 | Jenkins | 5/503.1 |
| 4,938,402 | 7/1990 | Anatra | 224/411 |
| 5,154,331 | 10/1992 | Sanders | 224/407 |
| 5,370,246 | 12/1994 | Traynor | 211/86 |

FOREIGN PATENT DOCUMENTS

| | | | |
|---|---|---|---|
| 1698050 | 12/1991 | Russian Federation | 294/146 |

*Primary Examiner*—Flemming Saether

[57] ABSTRACT

A removably attachable storage organizer which hangs on the upper most surface of a hospital bed rail. Inner and outer facing panels have attached to them a plurality of pockets capable of storing a variety of personal items that a patient may have with them during a stay at the hospital. A hingably connected rigid spine member connect the inner and outer panels together and a carry handle runs several inches above and parallel to the rigid spine and is held in place by flanges located at each end of the spine. Removably attachable straps are attached to either end of the organizer which prevent the organizer from sliding when the head of the bed is in a raised position causing the rail portion of the bed to be angled. A lockable storage box fits securely in one of the pockets and some of the pockets have specialized front surfaces for example, a slit front surface for the dispensing of facial tissue and a framed front surface for inserting a photograph of the like. The outer most surface of the outer pockets has a thin pocket for inserting a label containing the patients name.

4 Claims, 6 Drawing Sheets

STORAGE ORGANIZER FOR HOSPITAL BED

BACKGROUND OF THE INVENTION

This invention relates to a storage device which is attached to a standard hospital bed side rail.

When a person has a medical problem which requires them to spend time in a hospital, they frequently bring personal items with them such as eye glasses, jewelry, dentures, photos, magazines, tissues, toiletries and the like. There are few convenient places to put such items in a hospital room environment. If a small table next to the bed is provided, it is often cluttered with hospital food trays or other hospital related items which may be moved by the attending nurse. Additionally, a person staying in a hospital may have items of value which they wish to have in close proximity to them such as a special piece of jewelry, an electronic organizer, or even such items as dentures. Although most hospitals have centrally located safes, there is no place for a hospital patient to lock up personal belongings and to also have them in close proximity to their hospital bed. Additionally, a patient may be moved from one room to another in which case their personal belongings are liable to get misplaced during the move.

Therefore, there is a need for a storage organizer which is removably attached to the side rail of a hospital bed which is capable of holding a variety of personal items as described above.

OBJECT OF INVENTION

It is an object of the present invention to provide a removably attachable storage device which fits conveniently on the side rail of a standard hospital bed.

It is a further object of the present invention to provide a removably attachable storage device which is attached to the side rail in such a way that it does not slide away from the user when the head end and corresponding side rail of the hospital bed is raised.

It is a further object of the present invention to provide a removably attachable storage device which can be personalized with the user's name and other information unique to the individual user.

It is a further object of the present invention to provide a removably attachable storage device which includes a carry handle for easy transport.

It is a further object of the present invention to provide a removably attachable storage device in which some pockets have specialized front surfaces for tissue dispensing and a picture holder.

It is a further object of the present invention to provide a removably attached storage device which has a lockable storage box fitted into one of the storage pockets.

It is a further object of the present invention to provide a removably attachable storage device which can be manufactured inexpensively out of easily cleanable material.

It is a further object of this invention to provide a removably attachable storage device in which some or all of the items are already contained within the organizer when it is purchased.

To this end, these and other objects of the present invention are accomplished by a light weight organizer which is made up of an inner panel, an upper spine and attached handle, and an outer panel. The inner panel contains a series of small pockets and the outer panel has several large pockets one of which is capable of holding magazines or a book, the other of which contains a lockable storage box. Straps are located at either end of the upper spine which are capable of attaching the storage organizer to a Standard hospital bed rail so that the unit stays in place even when the rail is at an angled position as is the case when the head or foot end of the bed is raised. A thin pocket having a dear window area located in the outer panel has a card which may be personalized wilt the owners name and other pertinent information.

DETAILED DESCRIPTION OF DRAWINGS

Figure 1:
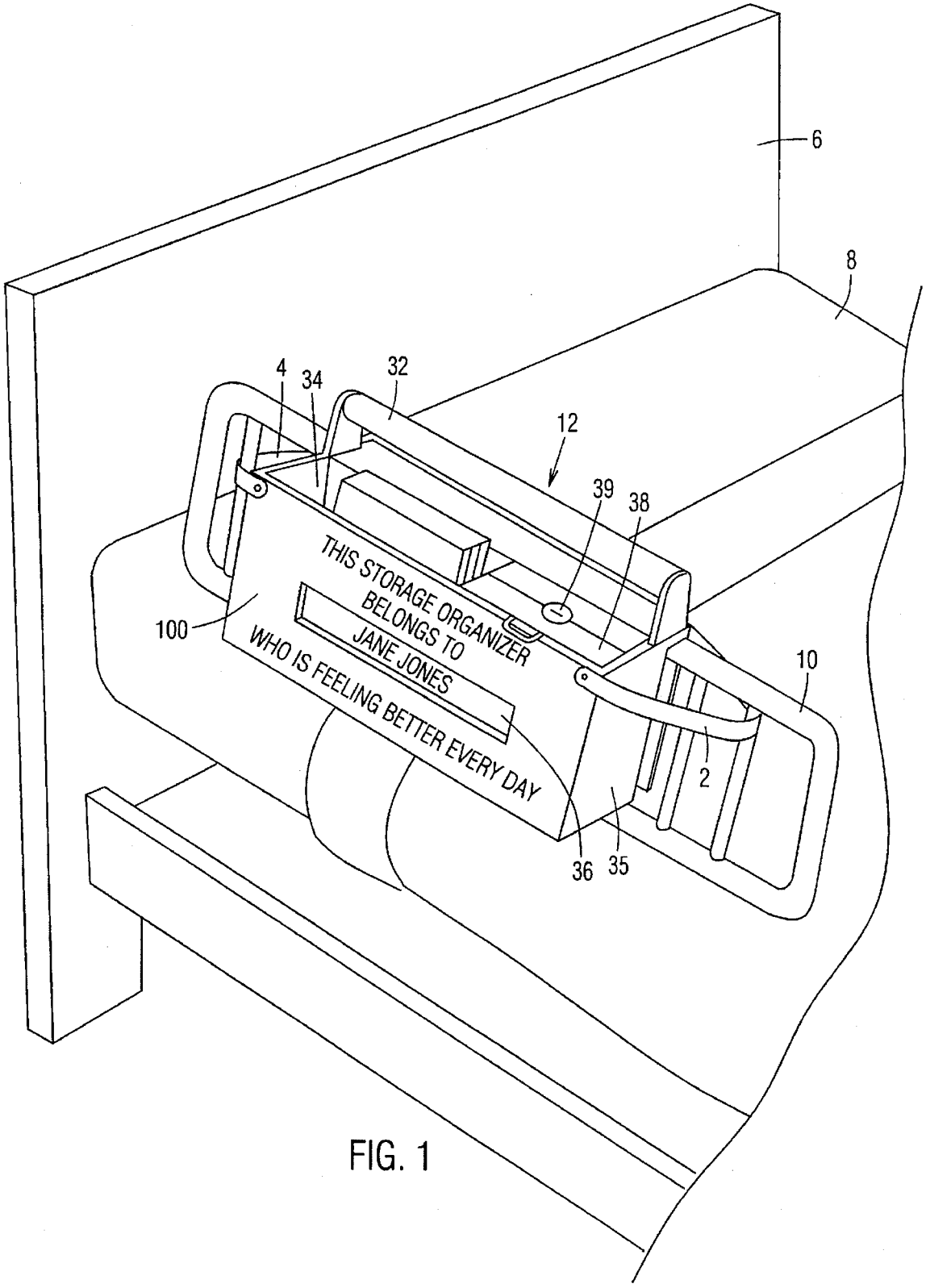
FIG. 1. is a perspective view of the hospital bed organizer of the present invention showing the outside panel and associated pockets.

FIG. 1. shows the configuration of the outer panel 100 and attachment of the entire unit 12 to a hospital rail 10 by means of releasable swaps 2 or 4 which also prevent the entire assembly 12 from sliding off the bed raft 10 is tilted upward during normal use of the hospital bed 8. The outer panel 100 has two main compartments 34 and 35. Compartment 34 is sized to hold magazines and/or books. Compartment 35 contains a removable box 38 which is capable of being locked 39 with a key or by other standard locking means. Outer panel 100 also has a place to insert a personalized label 36 so that the organizer can be identified by patient name.

Figure 2:
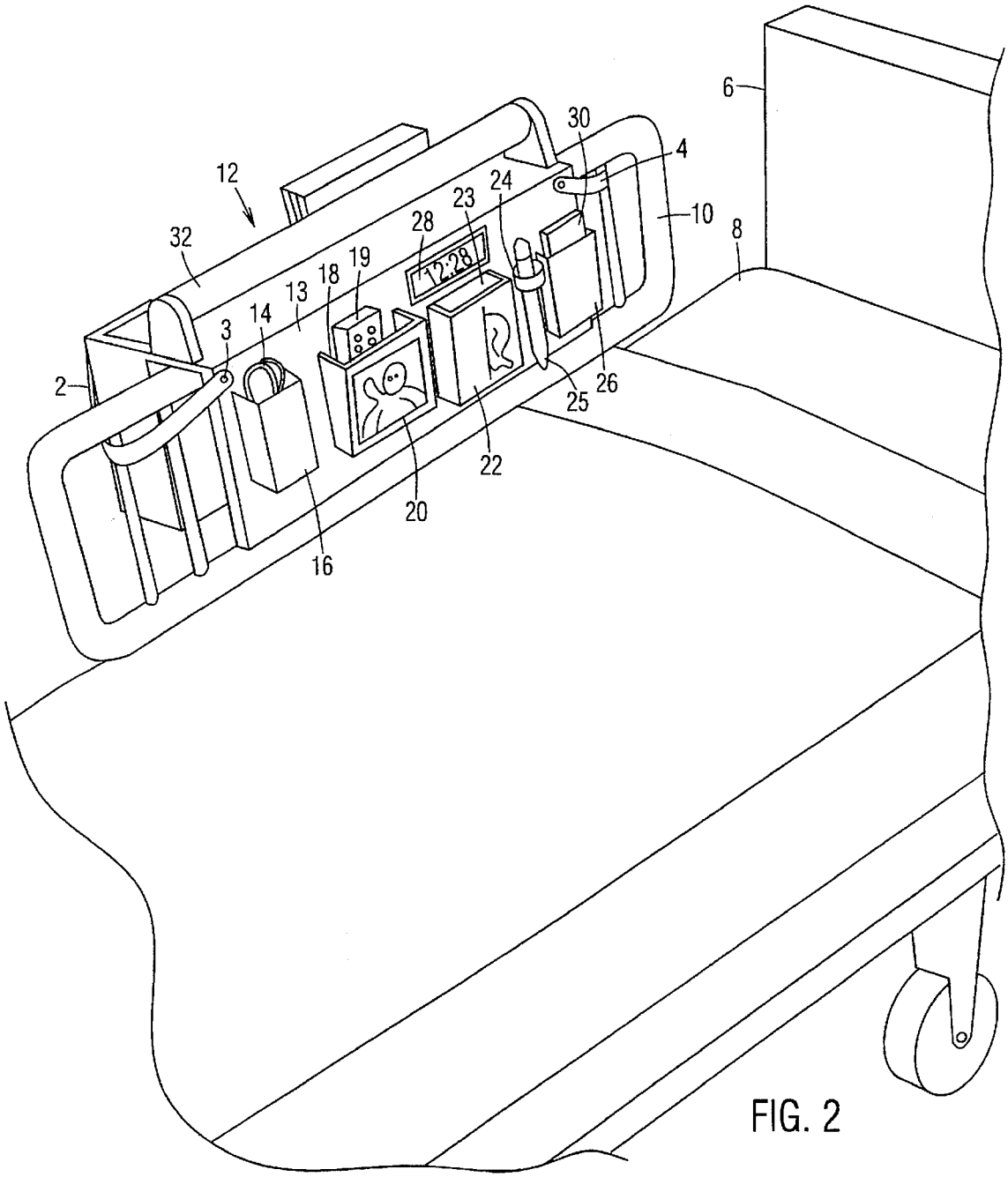
FIG. 2. is a perspective view of the hospital bed organizer of the present invention showing the inside panel and associated pockets.

FIG. 2. shows the inner panel 13 of the organizer 12 of the present invention. Multiple small pockets on the inner panel can hold a variety of objects such as eyeglasses 14 located in pocket 16, a T.V. remote control 19 located in pocket 18. Pocket 18 also has attached to its outside surface an additional thin pocket 20 with a clear window on the outside which can act as a picture frame. Pocket 22 contains a vertical slit in it's outside center area so that an individual pack of tissues 23 can be held and dispensed. A pen holder 24 holds pen 25. Pocket 26 holds a note pad 30 or perhaps a deck of carols. Digital clock 28 can be built into panel 19 or can be added by user. Retaining strap 2 can be released by snap fastener 3 or other standard means of releasable detachment.

Figure 3:
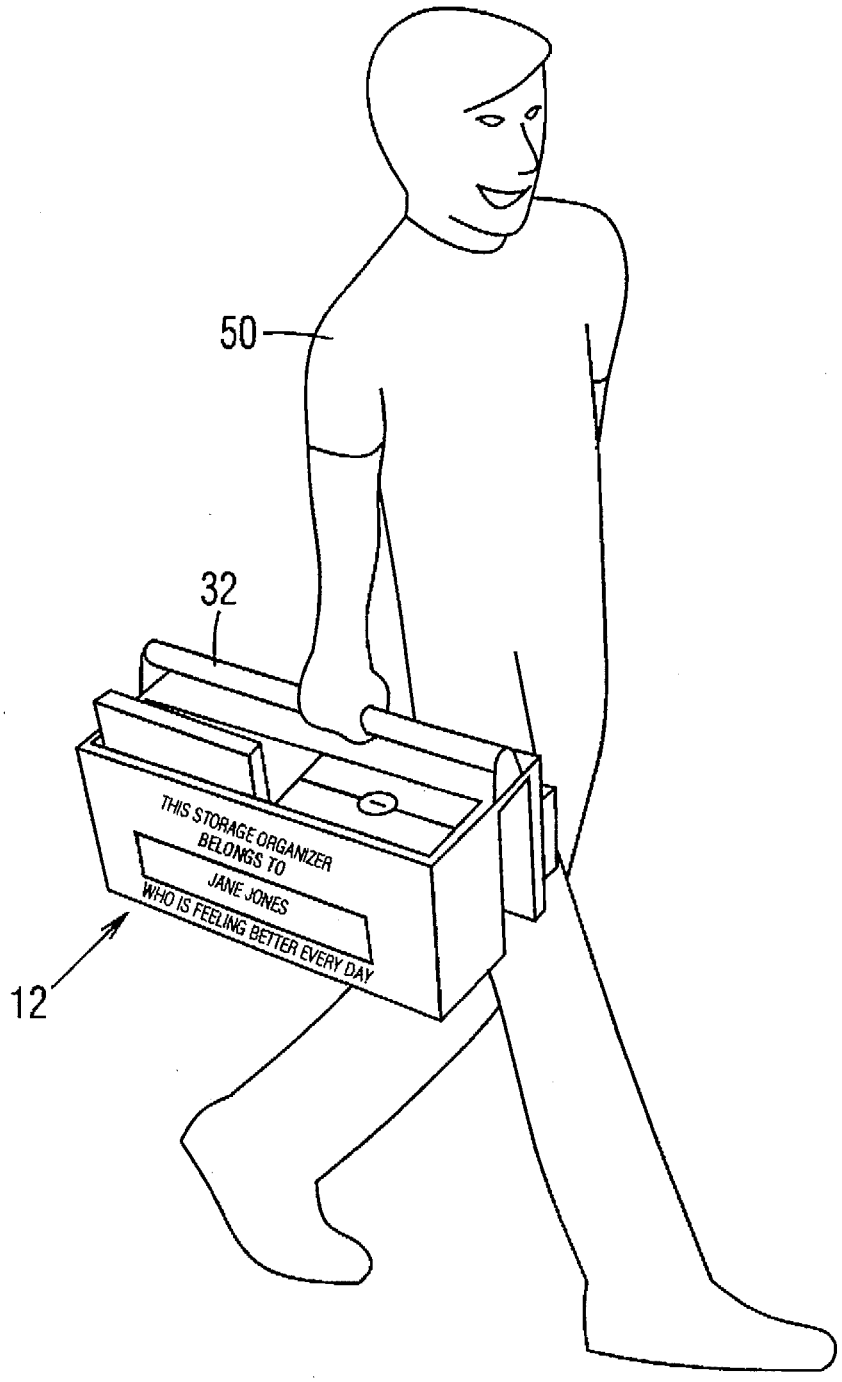
FIG. 3. is a perspective view of the hospital bed organizer of the present invention showing a person carrying the present invention by it's handle.

FIG. 3. shows a user carrying the organizer 12 by built in handle 32. In this way the organizer 12 can be easily carried to a different location.

Because the hospital storage organizer of the present invention is hopefully a one time use item, it's manufacture must be relatively inexpensive to produce. To this end FIG. 5. shows a plan view layout of the entire unit 12 which can be die cut and scored out of an inexpensive, die curable, semi rigid material such as corrugated plastic, thin vinyl, plastic coated corrugated paperboard or foam core board.

The material should also be water resistant so it can withstand occasional cleaning.

Figure 4:
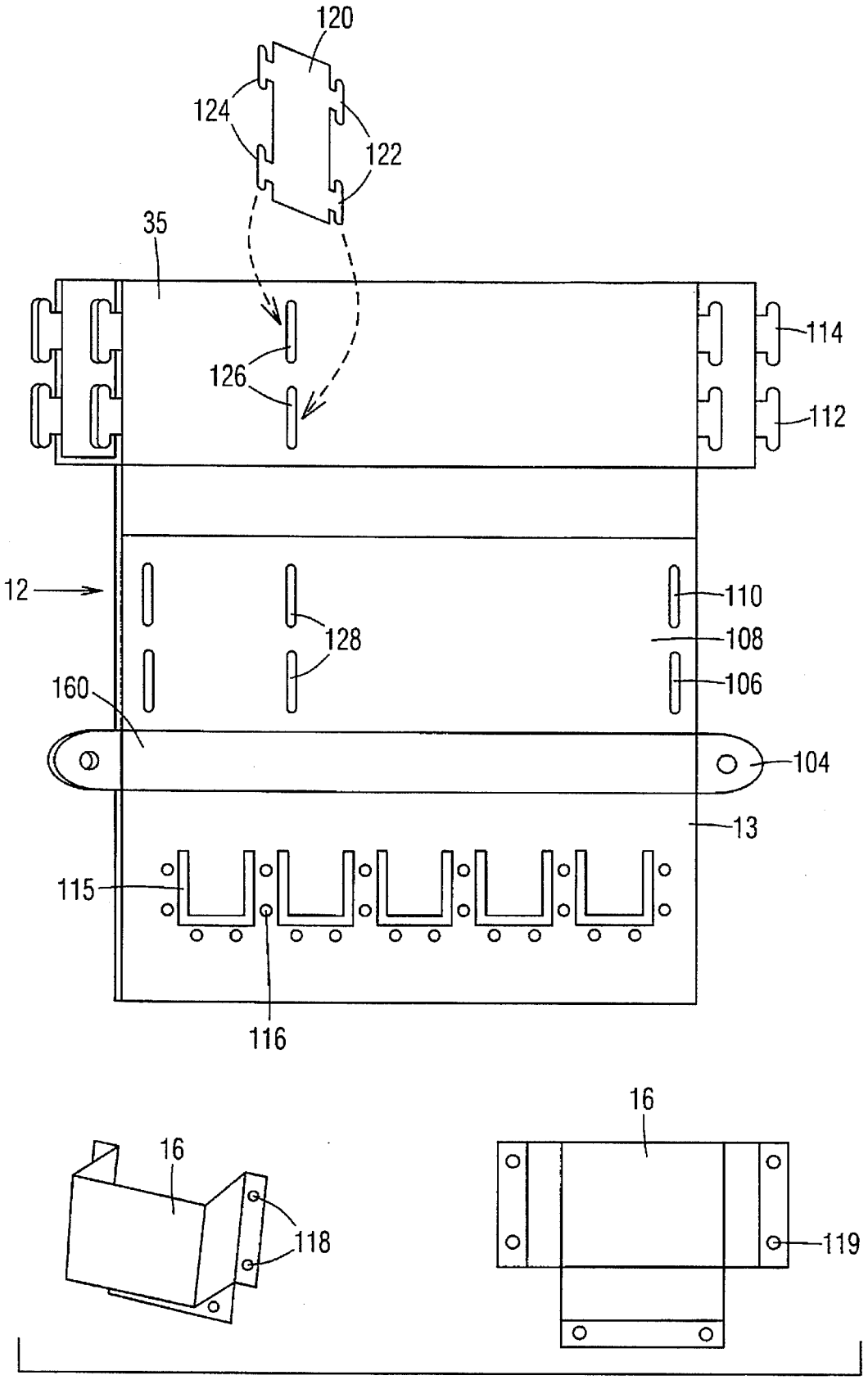
FIG. 4. is a plan view layout of the hospital bed organizer of the present invention.

The layout in FIG. 4. shows the inner panel 13 having a series of die cut "U" shaped cut outs 115. A plurality of holes 116 surround each "U" shaped cut out 115. Pocket 16 is made of similar die cuttable material and can be folded so that holes 119 match holes 118. Section 108 and 35 form the outward storage portion and are held together by tabs 114 ½ and slots 110, 106. Panel 120 forms a partition In the outer storage area when tabs 124, 122 are inserted into slots 126,128. Inner panel 13 and section 108 are hingeably connected to opposite edges of a narrow rigid spine 160 .

Figure 5:
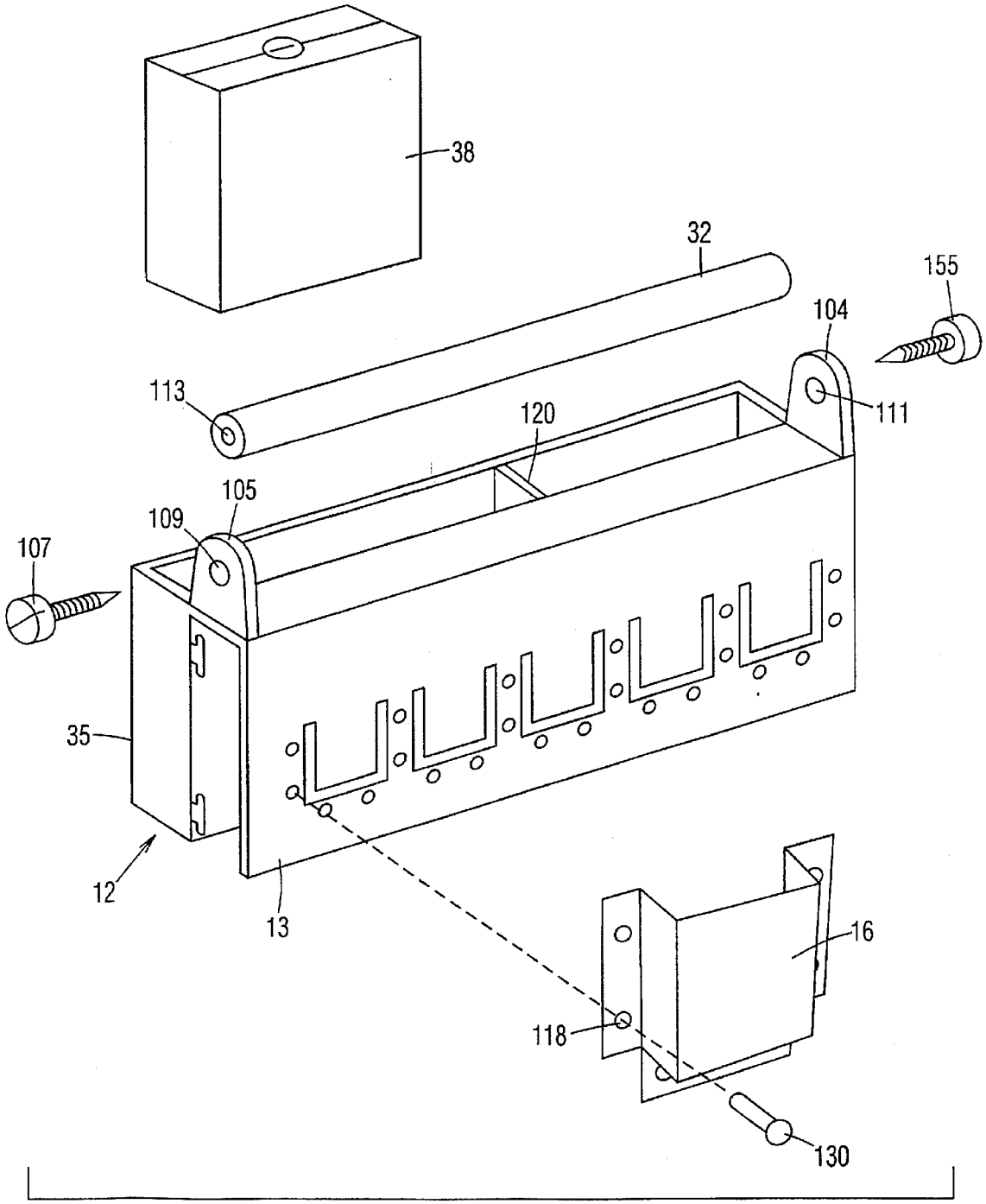
FIG. 5. is an assembly view of the hospital bed organizer of the present invention.

FIG. 5. shows hospital storage unit 12 partially assembled. Outer partitions 35 are in place and divider 120 is in place. Tabs 104 and 105 are folded up 90°. Holes 109,111 in tabs 104, 105 allow for screws 107,155 to be inserted and screwed into holes 113 of handle 32. Pocket 16 is held in place by rivet 130 or similar means. Lock box fits into outer compartment 35.

Figure 6:
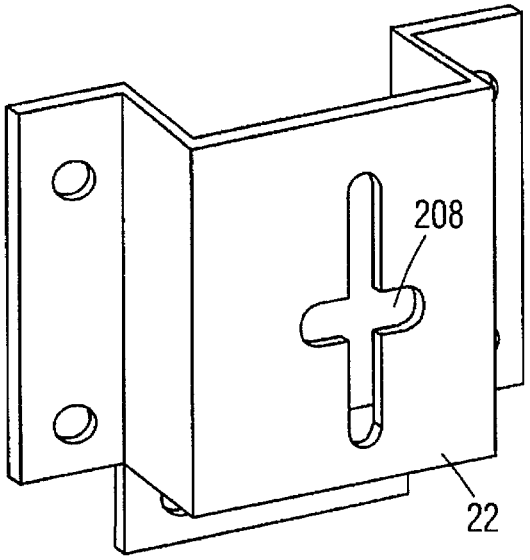
FIG. 6. is a perspective view of the tissue holder.

FIG. 6. shows a custom tissue pocket 22 where slit 208 allows tissues to pass through.

Figure 7:
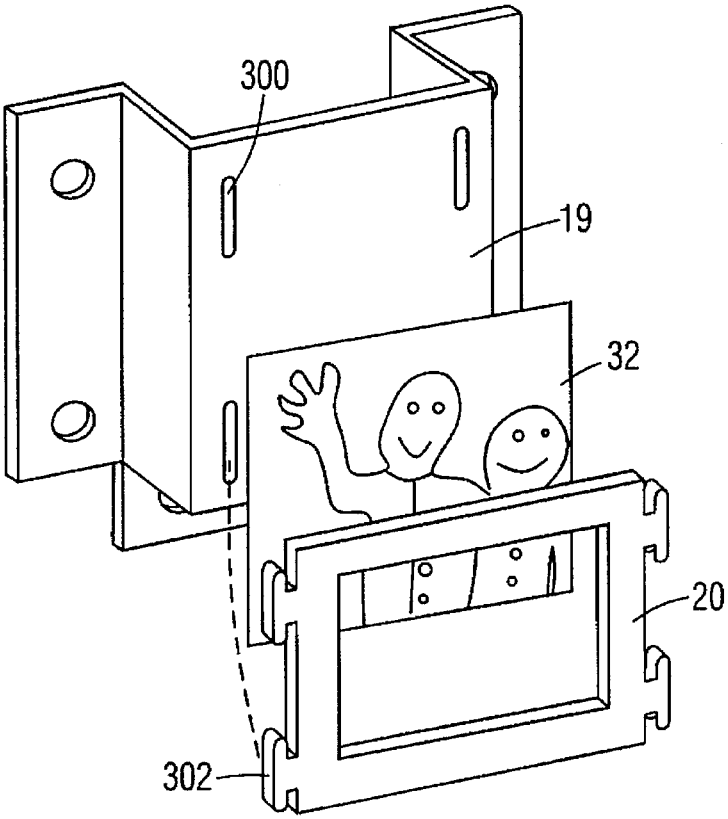
FIG. 7. is a perspective view of the picture frame.

FIG. 7. shows custom pocket 19 which has slots 300 In front surface to accept tabs 302 of frame. 20. Photograph 32 or other personal graphic image can be slipped into the pocket formed by frame 20 and front of pocket.

Therefore I claim:

1. A removably attachable storage organizer for hanging on a top most surface of a hospital bed rail, comprising:

a substantially rectangular inner panel terminating at a top edge thereof in an integral hinged portion which is attached to a side of a planar rigid spine positioned at 90 degrees to said inner panel, said inner panel having opposite ends, said spine having opposite ends;

a second hinged portion attached to an opposite side of said spine to which an outer panel is attached at 90 degrees to said spine, said outer panel being parallel to said inner panel, said outer panel having opposite ends;

a pair of removably attachable straps located at said opposite ends of said outer panel and said inner panel for fastening said storage organizer to the hospital bed;

said inner panel having a plurality of inner pockets for holding small personal items, said outer panel having two outer pockets, one of said outer pockets for holding reading material, another one of said outer pockets for holding a lockable storage box for holding valuable personal items;

said spine having a pair of tabs at said opposite ends thereof; and a carry handle connected between said tabs, said carry handle being parallel to and spaced several inches above said spine.

2. The removably attachable storage organizer of claim 1, further including a name holding pocket adhered to an outer most surface of said outer panel.

3. The removably attachable storage organizer of claim 1, wherein said inner pockets include specialized front surfaces, including a pocket having a slit front surface for dispensing of facial tissue and a pocket having a front surface for sorting and displaying a personal photograph.

4. The removably attachable storage organizer of claim 1, wherein said storage organizer is constructed of an easily cleanable, semi-rigid, die-cuttable and scorable material.

* * * * *